US005209472A

United States Patent [19]

Tseng

[11] Patent Number: 5,209,472

[45] Date of Patent: May 11, 1993

[54] RACKET WITH FRAME ATTACHMENTS

[76] Inventor: Kuni Tseng, 6F-1, No. 342, Keelung Road, Sec. 1, Taipei, Taiwan

[21] Appl. No.: 883,790

[22] Filed: May 15, 1992

[51] Int. Cl.[5] ..... A63B 51/06; A63B 49/02

[52] U.S. Cl. ..... 273/73 C; 273/73 D

[58] Field of Search ..... 273/73 R, 73 A, 73 B, 273/73 C, 73 D, 73 E, 73 G, 73 L

[56] References Cited

U.S. PATENT DOCUMENTS

| | | | |
|---|---|---|---|
| 1,502,845 | 7/1924 | Blache | 273/73 D |
| 4,049,269 | 9/1977 | Blackburne | 273/73 D |
| 4,204,680 | 5/1980 | Blackburne | 273/73 D |

FOREIGN PATENT DOCUMENTS

| | | | |
|---|---|---|---|
| 4010722 | 10/1991 | Fed. Rep. of Germany | 273/73 D |

*Primary Examiner*—V. Millin
*Assistant Examiner*—William E. Stoll
*Attorney, Agent, or Firm*—Pro-Techtor International

[57] ABSTRACT

A racket with frame attachments disposed on two diametrically opposite positions, each attachment comprises two rows of a plurality of stringing passages along both edges in respective inclined alignment to each other and a recess at the central space in the area between two rows of the stringing passages for fittingly enclosing the corresponding frame portion.

6 Claims, 9 Drawing Sheets

FIG. 14
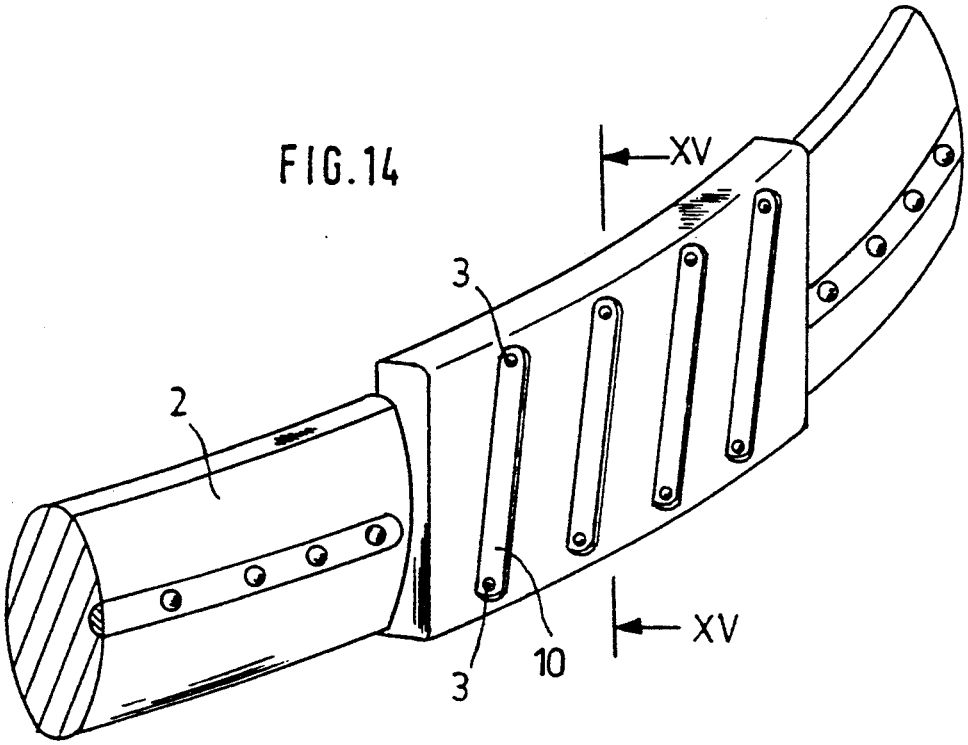
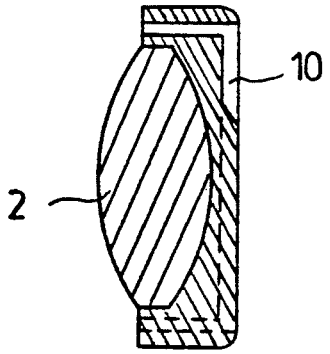
FIG. 15

RACKET WITH FRAME ATTACHMENTS

FIELD OF THE INVENTION

This invention relates to a racket with frame attachments.

Conventionally, a racket is provided with a plurality of stringing holes in linear sequence along substantial center line on the frame for the strings passing therethrough. Due to the thickness of the frame, the strike surface interweaved by the srtings is lower than the surface of the frame by a half of said thickness, so as to cause a hindrance in striking the ball.

In order to overcome the aforementioned drawback, several developments were suggested, for example, as disclosed in Taiwan patent publications Nos. 133073 and 140356. In these disclosures of the prior art, the arrangement of the stringing holes in linear sequence of single row is replaced by an inclined alignment of double rows. In other words the stringing holes is displaced to both edgeas from the center line in order to raise the strike surface. But since most of the rackets are presently made of resins reinforced by carbon fibers, in which, on the one hand, the strength of the material will be impaired when the stringing holes are drilled and, on the other hand, if the stringing holes are drilled too close to the rims of the frame, the stringing holes have the risk to be broken during the stringing operation, so that the distance of the stringing holes from adjacent rim should be more than 5 mm.

In another suggestion, the stringing holes are not provided, instead the strings are passed around the surface of the frame. In this case, the racket in performance has a great chance to touch the ground and thus readily to cause the strings broken.

SUMMARY OF THE INVENTION

It is, therefore, an object of the present invention to obviate the shortcomings of the conventional rackets previously discussed, and to provide a novel racket with frame attachments disposed on two dimensional diametrical opposite positions, each attachment comprises two rows of a plurality of stringing holes or grooves integrally moulded by resins along both edges in respective inclined alignment to each other and a recess at the central space in the area between said two rows of stringing holes or grooves for fittingly enclosing the corresponding frame portion.

BRIEF DESCRIPTION OF THE DRAWINGS

The foregoing and other objects, features and advangages of the invention will be apparent from the following particular description of preferred embodiments of the invention as illustrated in the accompanying drawings, in which:

FIG. 14 is a perspective view of the frame attachment in a further still another embodiment enclosed onto the corresponding portion of ordinary frame, and FIG. 15 is a cross sectional view taken along the line XV-XV of FIG. 14.

DETAILED DESCRIPTION OF PREFERRED EMBODIMENTS

Figure 1:
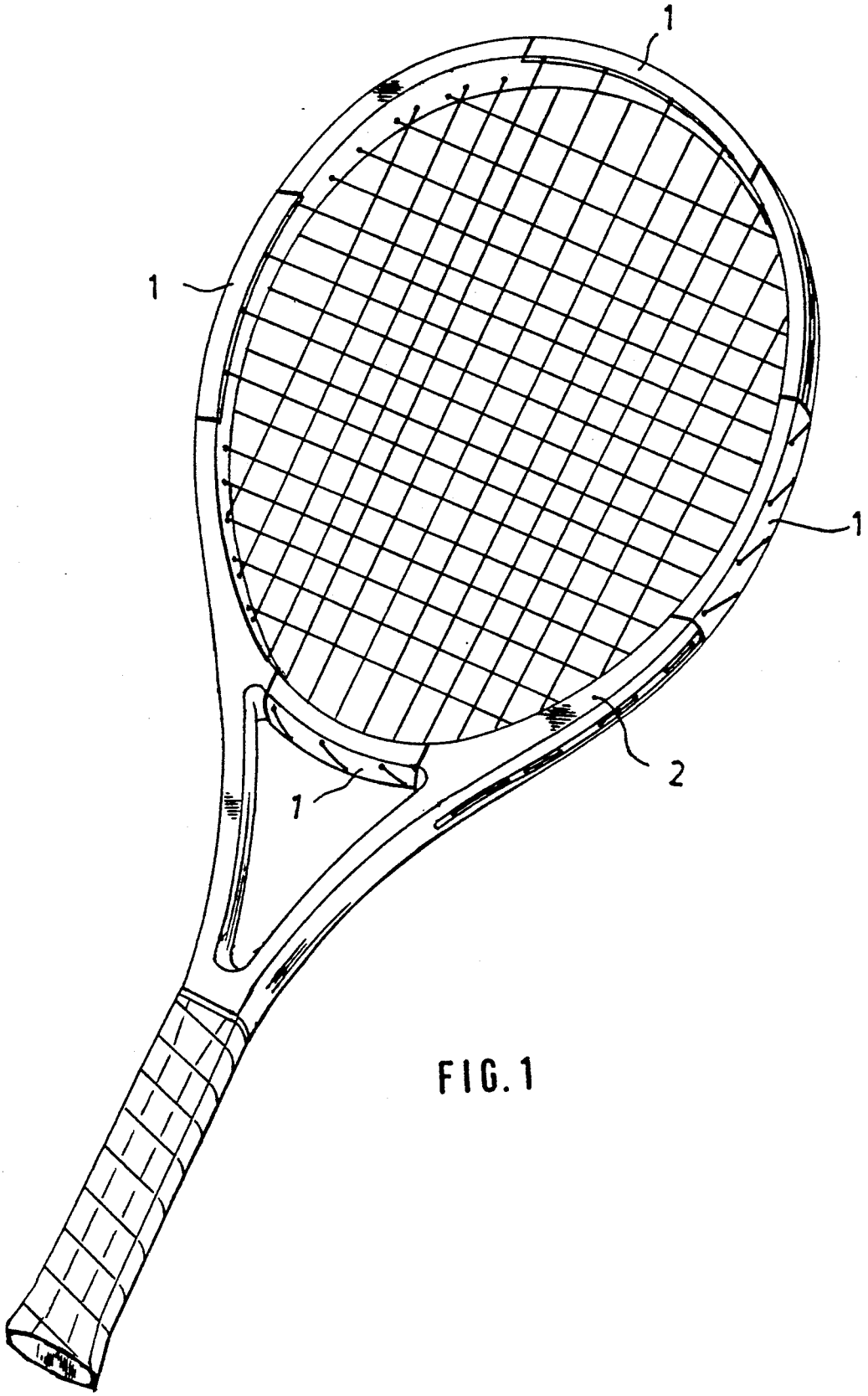
FIG. 1 is a prespective view of the racket with frame attachments according to one embodiment of the present invention.
Figure 2:
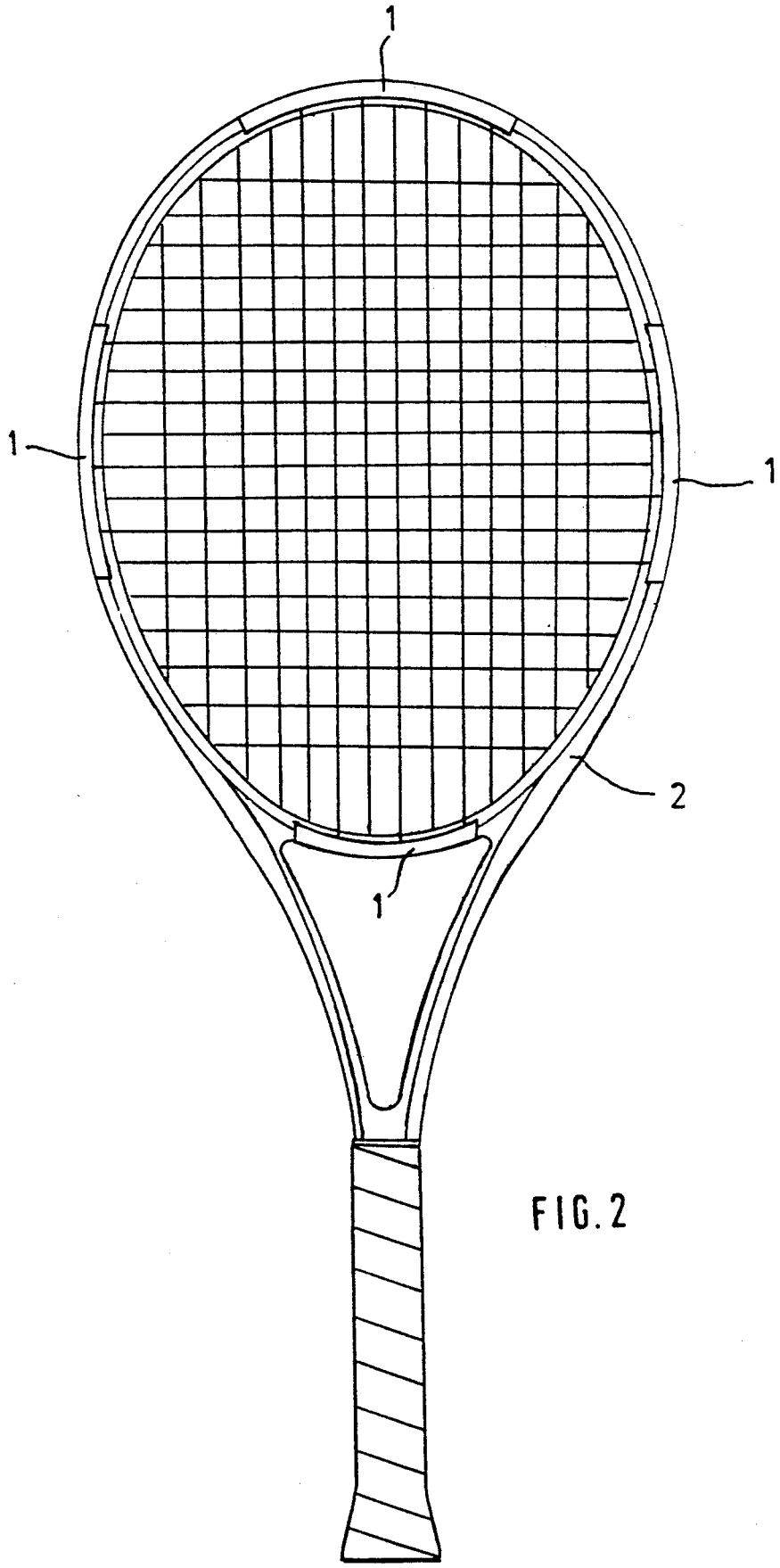
FIG. 2 is a plain view of FIG. 1.
Figure 3:
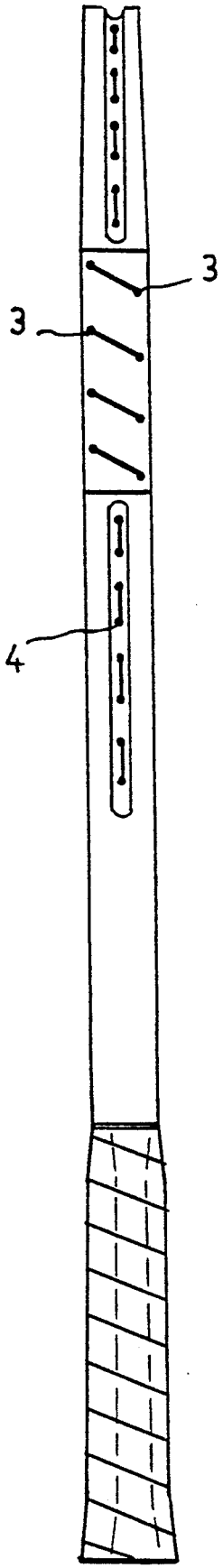
FIG. 3 is a side view of FIG. 1.
Figure 4:
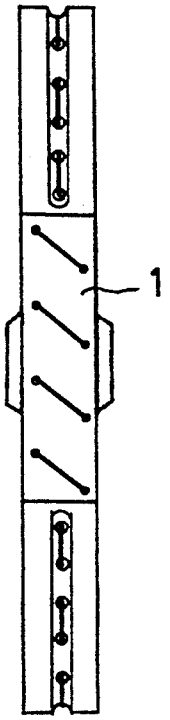
FIG. 4 is a top view of FIG. 1.

Now, reference is made to FIGS. 1 to 4 of the drawings, in which the racket is provided with four frame attachments 1 disposed at dimensional diametrical positions on the frame 2. Along both edges of said frame attachment 1 there are two rows of stringing means 3 in the form of holes in parallel and respective inclined alignment to each other. Outside of said frame attachment 1 the stringing holes 4 are remained in linear sequence along the center line.

Figures 5, 6:
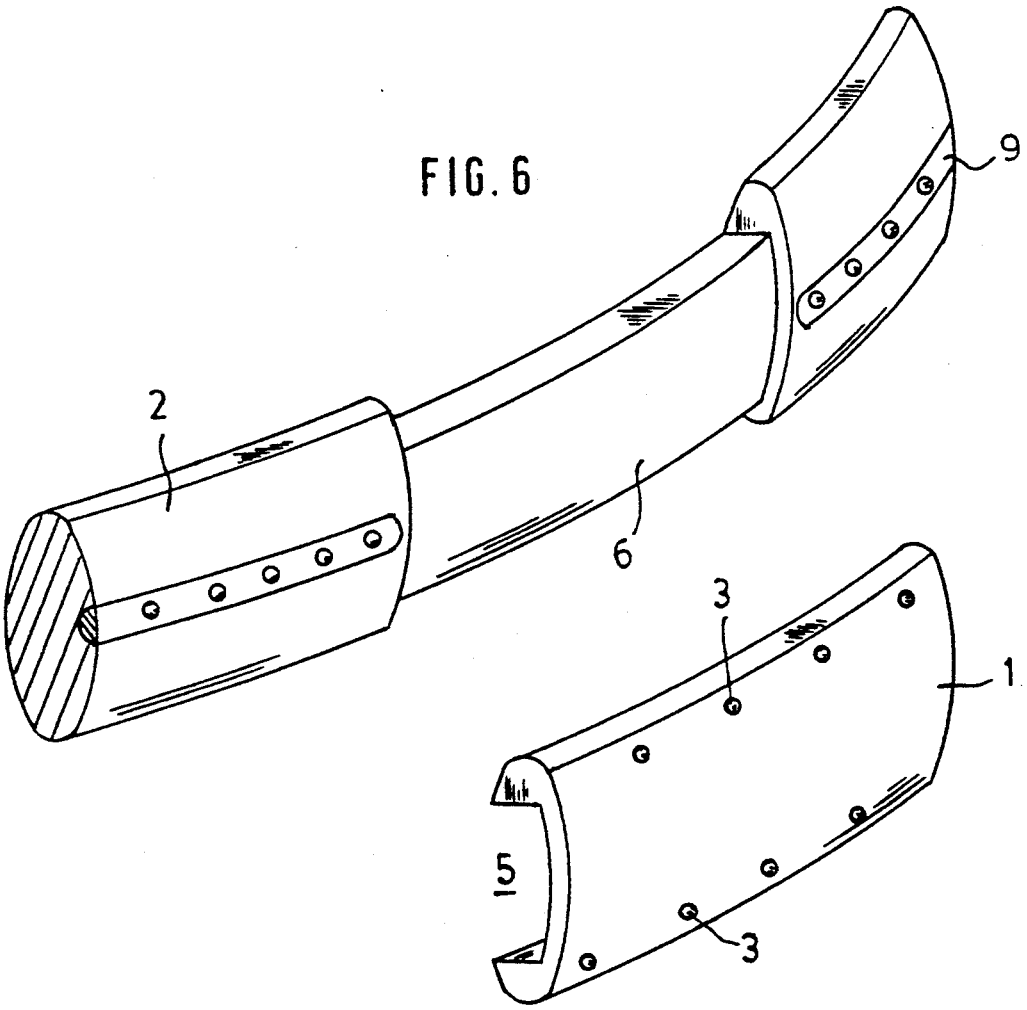
FIG. 5 is an enlarged perspective view of the frame attachment as illustrated in FIG. 1.
FIG. 6 is a perspective view of the frame portion in cooperation with the frame attachment of FIG. 5.
Figure 7:
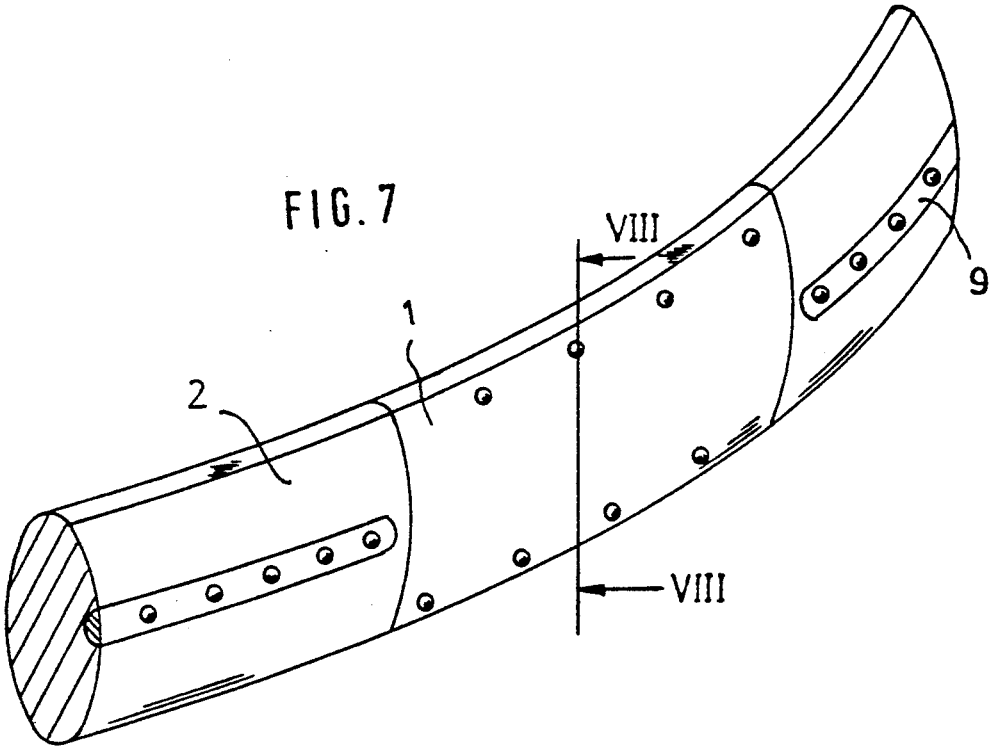
FIG. 7 is a perspective view illustrating the assembling of the frame attachment of FIG. 5 on the frame portion of FIG. 6.
Figure 8:
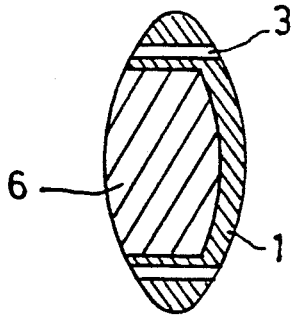
FIG. 8 is a cross sectional view taken along the line VIII—VIII of FIG. 7.

One preferred embodiment of present frame attachment 1 is illustrated in FIG. 5. There is a recess 5 at the central space in the area between said two rows of stringing holes 3. In cooperation with said attachment 1, the corresponding frame portion 6 is reduced at three sides except that the inner side is flat, so that when said attachment 1 is fittingly snapped or securely glued on the corresponding frame portion 6, a unitary appearance is presented as shown in FIG. 7. The recess 5 is just complementary with the reduced frame portion 6 and the stringing holes 3 are located at both lateral edges outside of said recess 5, namely, said recess 5 is at the central space in the area between said two rows of said stringing holes 3, as best shown in FIG. 8. Because said holes 3 are integrally moulded with said attachment 1 so that the distance of said holes 3 from the outmost rim of the attachment 1 may be reduced to a smaller than 5 mm, as desired. Therefore, the strike surface formed by the interweaved strings passing through said stringing holes 3 is raised to more close to the frame surface without the risk to cause any of said holes 3 broken.

Figure 9:
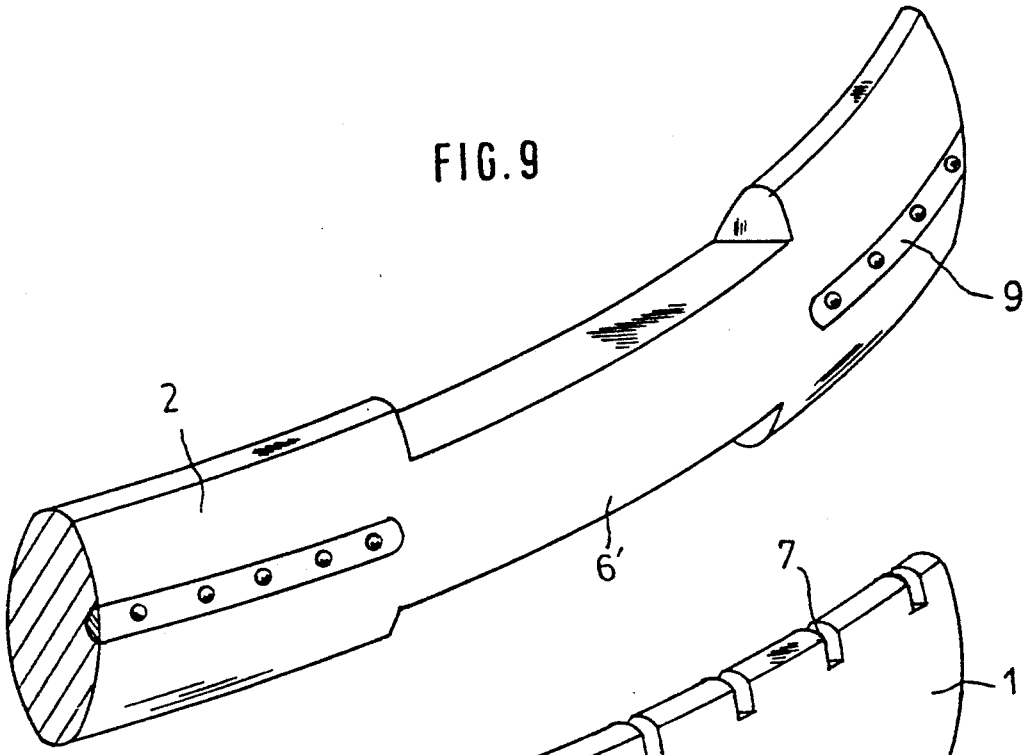
FIG. 9 is a perspective view of the frame portion in another embodiment.

FIG. 9 represents an alternative embodioment of the reduced frame portion 6', in which only both lateral sides are reduced and inner- and outer sides are flat to other portion of the frame 2. In this case when the present frame attachment 1 is assembled onto said reduced portion 6', the outside of said attachment 1 will be out of the other frame portion.

Figure 10:
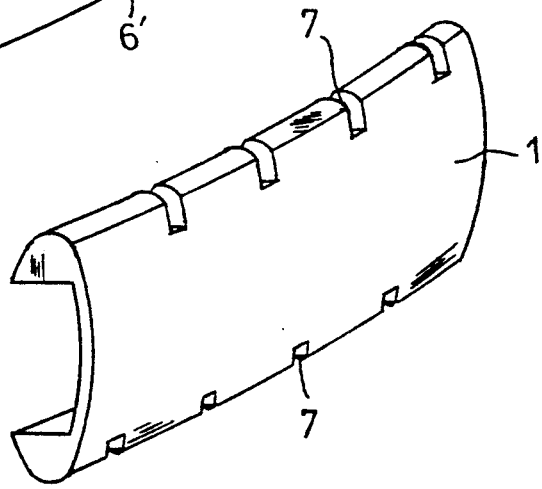
FIG. 10 is a perspective view of the frame attachment in an alternative embodiment.

Another embodiment of present frame attachment is illustrated in FIG. 10, in which the stringing means are in the form of stringing grooves 7. Since the depth of said grooves 7 is greater than the diameter of the strings (not shown), so that the strings passing through said grooves 7 would not be emerged out of said attachment 1 and thus impossible to touch the ground by accident.

Figure 11:
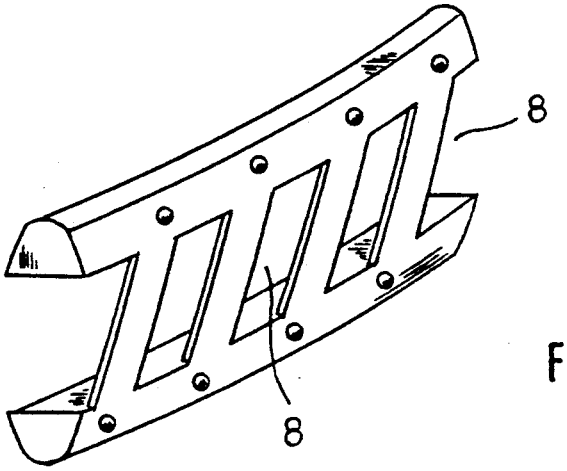
FIG. 11 is a perspective view of the frame attachment in another embodiment.

FIG. 11 shows another embodiment of the present frame attachment, which is a modification of the embodiment as shown in FIG. 5. In this embodiment a pluraluty of openings 8 are formed outside of the area on the connection between each pair of stringing means in order to save the material and thus to reduce the weight. Similarly, in the embodiment as shown in FIG. 10, a plurality of opening 8 may be formed too.

Figure 12:
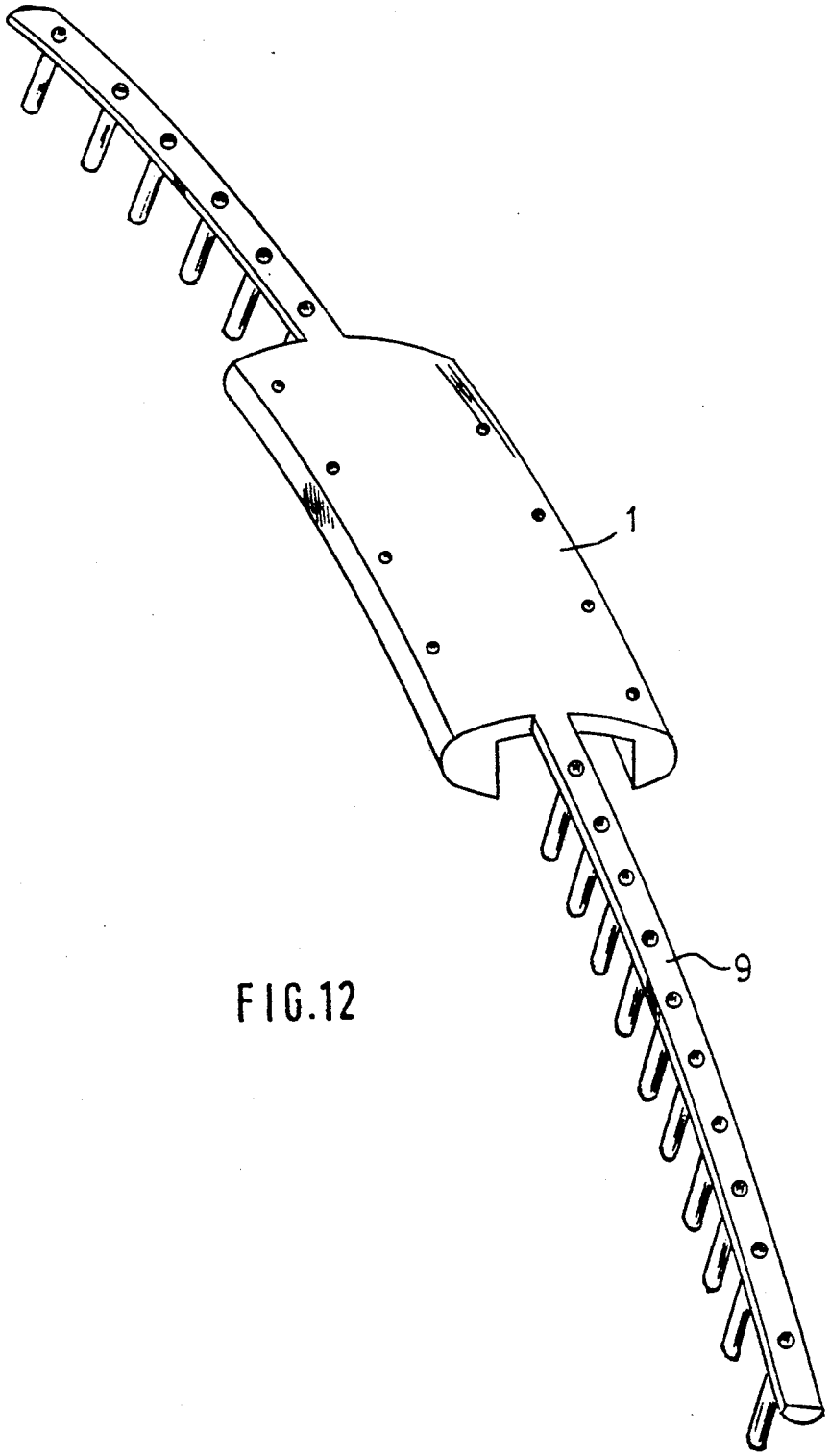
FIG. 12 is a perspective view of the frame attachment in a still another embodiment unitary formed with the protective strip on the frame.

Further, the present frame attachment 1 may be unitary formed with the protective strip 9 on the frame as shown in FIG. 12.

Figure 13:
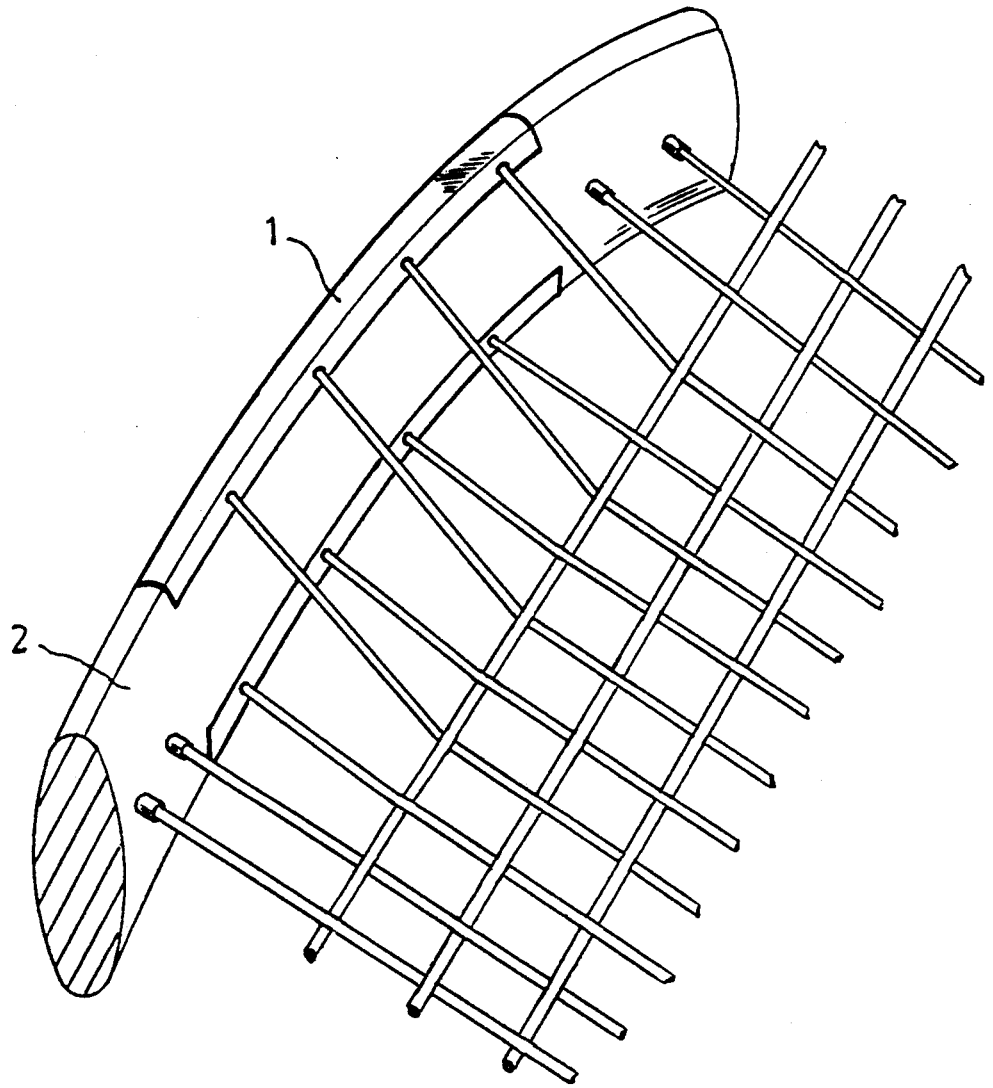
FIG. 13 is a fragmentary perspective view of the frame with a 35 portion of strings.

As represented by Fig. 13, the inner side of the frame 2 is remained flat even at the portion that present frame attachment 1 is disposed.

Further another embodiment of present invention is illustrated in FIG. 14, in which the frame 2 is ordinary, i.e. no reduced portion is provided. In this case, when the frame attachment 1 is enclosed around the frame 2, there are three sides raised over the frame 2 except that the inner side is flat, as referred to FIG. 13.

Also as shown in FIG. 14, a plurality of recessed channels 10 may be formed in communication between each pair of corresponding stringing holes 3 to receive the strings (not shown). Of course, the embodiments as shown in FIGS. 5, 10 and 11 may be implemented in this way too.

Although the invention has been described in detail with reference to its presently preferred embodiments, it will be understood by one skilled in the art that various modification changes and variations can be made without departing the spirit and scope of the invention.

What is claim is:

1. A racket comprising:

a handle; and a frame head including four removable attachments mounted on the frame head at 90° intervals, the attachments being centered at the 0°, 90°, 180° and 270° positions, 0° being the center of the attachment point of the handle to the frame head;

the attachments having a U-shaped cross-section and comprising a central recessed surface and two thickened opposing lateral rims, the attachments being constructed to fit snugly on the corresponding portion of the frame head, and each attachment including two rows of stringing means to secure the strings of the racket, one row on each lateral rim, the rows being offset so that a line between one of the stringing means in a first row and a corresponding stringing means in a second row is not normal to the horizontal plane of the racket. and the frame head having only one row of stringing means in those areas not covered by the attachments.

2. The racket of claim 9 wherein:

recesses in the frame head are provided for the attachments so that the attachments do not extend above the upper and lower surfaces of the frame head.

3. The racket of claim 1 wherein:

recesses in the frame head are provided for the attachments so that the attachments do not extend above the upper and lower surfaces of the frame head, and further do not extend beyond the outer surface of the frame head.

4. The racket of claim 1 wherein:

the respective pairs of stringing means in the two rows are connected by a recesssed channel so that the string does not protrude beyond the surface of the frame head.

5. The racket of claim 1 wherein:

the stringing means are circular holes.

6. The racket of claim 1 wherein:

the stringing means are grooves in the upper and lower surfaces of the attachments.

* * * * *